US011183326B2

(12) United States Patent
Xu et al.

(10) Patent No.: US 11,183,326 B2
(45) Date of Patent: Nov. 23, 2021

(54) COIL STRUCTURE FOR A DRY-TYPE TRANSFORMER AND A WINDING METHOD THEREOF

(71) Applicant: TRITYPE ELECTRIC CO., LTD., Jiangmen (CN)

(72) Inventors: Kaixuan Xu, Jiangmen (CN); Yuxiang Qi, Jiangmen (CN); Danju Song, Jiangmen (CN); Wenjie Fang, Jiangmen (CN); Ling Zheng, Jiangmen (CN); Yucheng Zhou, Jiangmen (CN); Huaming Wang, Jiangmen (CN); Xueming Zhang, Jiangmen (CN); Fei Li, Jiangmen (CN)

(73) Assignee: TRITYPE ELECTRIC CO., LTD., Jiangmen (CN)

( * ) Notice: Subject to any disclaimer, the term of this patent is extended or adjusted under 35 U.S.C. 154(b) by 0 days.

(21) Appl. No.: 15/760,463

(22) PCT Filed: Nov. 22, 2017

(86) PCT No.: PCT/CN2017/112226
§ 371 (c)(1),
(2) Date: Mar. 15, 2018

(87) PCT Pub. No.: WO2019/075834
PCT Pub. Date: Apr. 25, 2019

(65) Prior Publication Data

US 2020/0243252 A1 Jul. 30, 2020

(30) Foreign Application Priority Data

Oct. 19, 2017 (CN) ..... 201710980569.2

(51) Int. Cl.
*H01F 27/30* (2006.01)
*H01F 27/28* (2006.01)
*H01F 41/074* (2016.01)

(52) U.S. Cl.
CPC ..... *H01F 27/2871* (2013.01); *H01F 41/074* (2016.01)

(58) Field of Classification Search
CPC ..... H01F 2027/328; H01F 27/2871; H01F 41/074
(Continued)

(56) References Cited

U.S. PATENT DOCUMENTS 3,775,719 A * 11/1973 Gainer ..... H01B 13/14 336/58
2007/0279177 A1* 12/2007 Sarver ..... H01F 27/2871 336/207
(Continued)

FOREIGN PATENT DOCUMENTS

CN 204927037 U 12/2015
CN 205428690 U 8/2016
(Continued)

OTHER PUBLICATIONS

International Search Report for International Application No. PCT/CN2017/112226 dated Jul. 19, 2018.
(Continued)

*Primary Examiner* — Ronald Hinson
(74) *Attorney, Agent, or Firm* — Finnegan Henderson Farabow Garrett & Dunner LLP

(57) ABSTRACT

The present disclosure discloses a coil structure for a dry-type transformer and a winding method therefor. The coil structure for a dry-type transformer comprises multiple coil layers and a supporting framework, which is provided with multiple supporting layers. The spacer blocks of each inter-
(Continued)

mediate supporting layer comprise a rising spacer block for rising and supporting spacer blocks in addition to the rising spacer block, a thickness of the rising spacer block being greater than a thickness of the supporting spacer block, and the rising spacer blocks of several intermediate supporting layers being staggered along the circumferential direction. The present disclosure decreases the height of the entire coil efficiently, meanwhile abates the problem that the wire is centralized in a single area, inhibits the temperature rise phenomenon of transformers efficiently, and prolongs the lifetime of transformers.

7 Claims, 4 Drawing Sheets

(58) Field of Classification Search
USPC ..... 336/207
See application file for complete search history.

(56) References Cited

U.S. PATENT DOCUMENTS

| | | | |
|---|---|---|---|
| 2014/0361862 | A1 | 12/2014 | Ballard et al. |
| 2019/0392981 | A1 | 12/2019 | Xu et al. |

FOREIGN PATENT DOCUMENTS

| | | | |
|---|---|---|---|
| CN | 106531416 | A | 3/2017 |
| CN | 107221410 | A | 9/2017 |
| CN | 207282288 | U | 4/2018 |

OTHER PUBLICATIONS

Written Opinion for International Application No. PCT/CN2017/112226 dated Jul. 19, 2018.

* cited by examiner

COIL STRUCTURE FOR A DRY-TYPE TRANSFORMER AND A WINDING METHOD THEREOF

CROSS-REFERENCE TO RELATED PATENT APPLICATIONS

This application is a National Stage Entry of International Application No. PCT/CN2017/112226, filed Nov. 22, 2017, which claims priority from Chinese Patent Application No. 201710980569.2, filed Oct. 19, 2017. The entire contents of the above-referenced applications are expressly incorporated herein by reference.

TECHNICAL FIELD

The present disclosure relates to the technical field of power equipments, and more particularly, to a coil structure for a dry-type transformer and a winding method thereof.

BACKGROUND

When a continuous coil of a transformer rises from a lower coil layer to an upper coil layer, a certain distance is required between the two coil layers for a rising operation thereof. The coil structure for conventional dry-type transformers of open three-dimensional wound core enables centralizing of the rising positions of each coil layer to a same circumferential position of the coil, i.e. the rising positions of each coil layer correspond vertically to each other along the axial direction. The rising positions of each layer are centralized at the same circumferential position of the coil, and the larger distance between each two layers that is required for each rising position increases the overall height of the entire coil; in the meanwhile, the rising at the same circumferential position causes that the local temperature of the area is higher than that of the other areas. All these affect the performance of the transformer coil structure.

SUMMARY

Based on this, the present disclosure aims to overcome the above deficiencies by providing a coil structure for a dry-type transformer and a winding method therefor, which can reduce the height of the entire coil efficiently, relieve the centralization of the wire in a single area, inhibit the temperature rise phenomenon of transformers, and prolong the lifetime of transformers.

The technical solutions thereof are as follows:

A coil structure for a dry-type transformer includes multiple coil layers formed by winding a wire, and a supporting framework for fixing the coil layers. The supporting framework is provided with multiple supporting layers. One coil layer is disposed between each two adjacent supporting layers. Each of the supporting layers includes several spacer blocks spaced along a circumferential direction. The spacer blocks of the different supporting layers are vertically arranged with an upper spacer block and a lower spacer block oppositively, and the supporting layers include a first supporting layer, a last supporting layer and several intermediate supporting layers disposed between the first supporting layer and the last supporting layer. The spacer blocks of each intermediate supporting layer include a rising spacer block for rising and supporting spacer blocks in addition to the rising spacer block. A thickness of the rising spacer block is greater than a thickness of the supporting spacer block, and the rising spacer blocks of several intermediate supporting layers are staggered along the circumferential direction.

In the coil structure for a dry-type transformer according to the embodiments described in the present disclosure, the supporting framework thereof for fixing the coil layers is provided with intermediate supporting layers, wherein each intermediate supporting layer is provided with one rising spacer block. The rising wire begins from the coiled previous coil layer and through the gap between the rising spacer block and the supporting spacer block adjacent thereto, then the winding of the wire is repeated in sequence of supporting spacer blocks—a rising spacer block—supporting spacer blocks to form a next coil layer. The rising spacer blocks are configured to raise the wire at some positions and to provide the rising distances as required for guaranteeing the rising. Meanwhile the rising spacer blocks of each intermediate supporting layer are staggered circumferentially. That is, not each spacer block on any vertical group of spacer blocks is needed to be raised or to be thickened as required for rising, instead distributed are the rising distances of the entire coil structure at different circumferential positions, which decreases the height of the entire coil efficiently, saves the usage amount of wires, decreases the material costs, and in meantime reduces the load losses of transforms, which is not only environmentally friendly but also highly efficient. Furthermore, since the rising positions of the transformer coil layers are distributed at different circumferential positions of the entire coil structure, the concentration degree of the wire in a single area is reduced, which reduces the temperature rise of transformers efficiently, and prolongs the lifetime of transformers. Additionally, because the rising positions of the transformer coil layers are distributed at different circumferential positions of the entire coil structure, the anti-short circuit ability of transformer coils are enhanced.

The aforementioned technical solution will be further illustrated as follows.

In one of the embodiments, the rising spacer blocks of several intermediate supporting layers are disposed circumferentially in a stepped form so as to enable the winding process of the coil to be regular and convenient, which improves the winding efficiency.

In one of the embodiments, the spacer blocks of the different supporting layers are vertically arranged with an upper spacer block and a lower spacer block oppositively to form a plurality of vertical groups of spacer blocks. Each group of vertical spacer blocks are connected with a connecting backplane to form a supporting strut. The supporting framework further includes a supporting inner cylinder. A plurality of the supporting struts are spaced circumferentially on the outer peripheral surface of the supporting inner cylinder, and each supporting strut is provided with at least one rising spacer block. The present disclosure achieves the circumferential winding of the coil with the supporting inner cylinder, meanwhile the supporting struts provide the vertical groups of spacer blocks to achieve a complete supporting framework with a compact structure.

In one of the embodiments, the number of the coil layers is defined as m, $m \geq 3$. The number of the supporting struts is defined as n, $n=m-1$, and each supporting strut is provided with one rising spacer block thereon. When it demands to coil a certain number of the coil layers, each supporting strut can be provided with one rising spacer block thereon, which on each supporting strut are correspondingly provided with a rising distance of one coil layer.

In one of the embodiments, the number of the coil layers is defined as m, $m \geq 4$, the number of the supporting struts is defined as n, $2 \leq n < m-1$, the number of the rising spacer blocks on the supporting struts is defined as x, x≥2, wherein m=x*n+1 of the supporting struts, and n−1 supporting spacer blocks are provided between two adjacent rising spacer blocks. When winding a certain number of the coil layers, each supporting strut also can be provided with two or more rising spacer blocks thereon so as to provide correspondingly a rising distance of the respective coil layer. At the same time the number of the supporting struts can be decreased to reduce the manufacturing costs.

In one of the embodiments, the numbers of the rising spacer blocks on each supporting strut are not uniform. According to the actual situation a respective number of the rising spacer blocks can be provided on each supporting strut.

In one of the embodiments, surfaces, facing the first supporting layer, of each spacer block provided on an intermediate supporting layer closest to the first supporting layer, are flush with each other so as to guarantee a configuration that the rising spacer block with thicker thickness can exceed the supporting spacer blocks with a thinner thickness so as to provide a larger distance between the layers. The distance between two adjacent supporting layers matches the thickness of a coil layer so as to compress the height of the entire coil structure as much as possible.

In one of the embodiments, all of the spacer blocks of the first supporting layer are first limiting spacer blocks, all of the spacer blocks of the last supporting layer are second limiting spacer blocks, and thicknesses of the first limiting spacer blocks and the second limiting spacer blocks are both greater than thicknesses of the rising spacer blocks so as to meet the intensity requirements for mounting and fixing of the coil.

In one of the embodiments, the thicknesses of the supporting spacer blocks are less than the thickness of the wire, the thicknesses of the rising spacer blocks are greater than or equal to the thickness of the wire, and thereby in condition of achieving the rising the height of the entire coil is be reduced as much as possible.

The present technical solution also provides a winding method of a coil structure for a dry-type transformer, includes the following steps:

step 1: winding a first coil layer on a first supporting layer;

step 2: rising along a winding direction within a gap between a rising spacer block on a next supporting layer and a supporting spacer block adjacent to the rising spacer block, repeating the winding in a sequence of supporting spacer blocks—a rising spacer block—supporting spacer blocks to form a second coil layer;

step 3: repeating the winding according to step 2 for a third coil layer, and a fourth coil layer . . . , wherein rising positions of the respective coil layers being staggered along a circumferential direction.

The winding method for the coil structure for a dry-type transformer as described in the embodiments of the present disclosure, by distributing all of the rising positions of the coil structure at different circumferential positions, decreases the height of the entire coil efficiently, saves the usage amount of wires, decreases the material costs, and in meantime reduces the load losses of transforms, which is not only environmentally friendly but also highly efficient. Furthermore, since the rising positions of the transformer coil layers are distributed at different circumferential positions of the entire coil structure, the concentration degree of the wire in a single area is reduced, which reduces the temperature rise of transformers efficiently, and prolongs the lifetime of transformers. Additionally because the rising positions of the transformer coil layers are distributed at different circumferential positions of the entire coil structure, the anti-short circuit ability of transformer coils are enhanced.

The aforementioned technical solution will be further illustrated as follows.

In one of the embodiments, the rising positions of the respective coil layers are disposed to be gradually increasing or decreasing in height along the circumferential direction so as to enable the entire winding process of the coil structure to be more regular, to simplify the winding process and to improve the winding efficiency.

DESCRIPTION OF REFERENCE NUMERALS

100. a supporting framework, 110. a supporting inner cylinder, 120. a supporting strut, 121. a first supporting strut, 122. a second supporting strut, 123. a third supporting strut, 124. a fourth supporting strut, 125. a fifth supporting strut, 126. a sixth supporting strut, 127. a seventh supporting strut, 128. an eighth supporting strut, 129. a connecting backplane, 130. a first supporting layer, 131. a first limiting spacer block, 140. an intermediate supporting layer, 141. a rising spacer block, 142. a supporting spacer block, 150. a last supporting layer, 151. a second limiting spacer block, 200. a coil layer.

DETAILED DESCRIPTION OF THE DISCLOSURE

In order to make the objectives, technical solutions and advantages of the present disclosure more clear, the present disclosure is further illustrated in detail in combination with the accompanying drawings and embodiments hereinafter. It should be understood that the specific examples described, are intended for purposes of illustration only and are not intended to limit the scope of the disclosure.

It will be illustrated that, when an element is referred to as being "fixed" on another element, it can be directly fixed on the other element or can be fixed on the other element via an intervening element. When an element is referred to as being "connected" with another element, it can be directly connected with the other element or can be connected with the other element via an intervening element.

Figure 1:
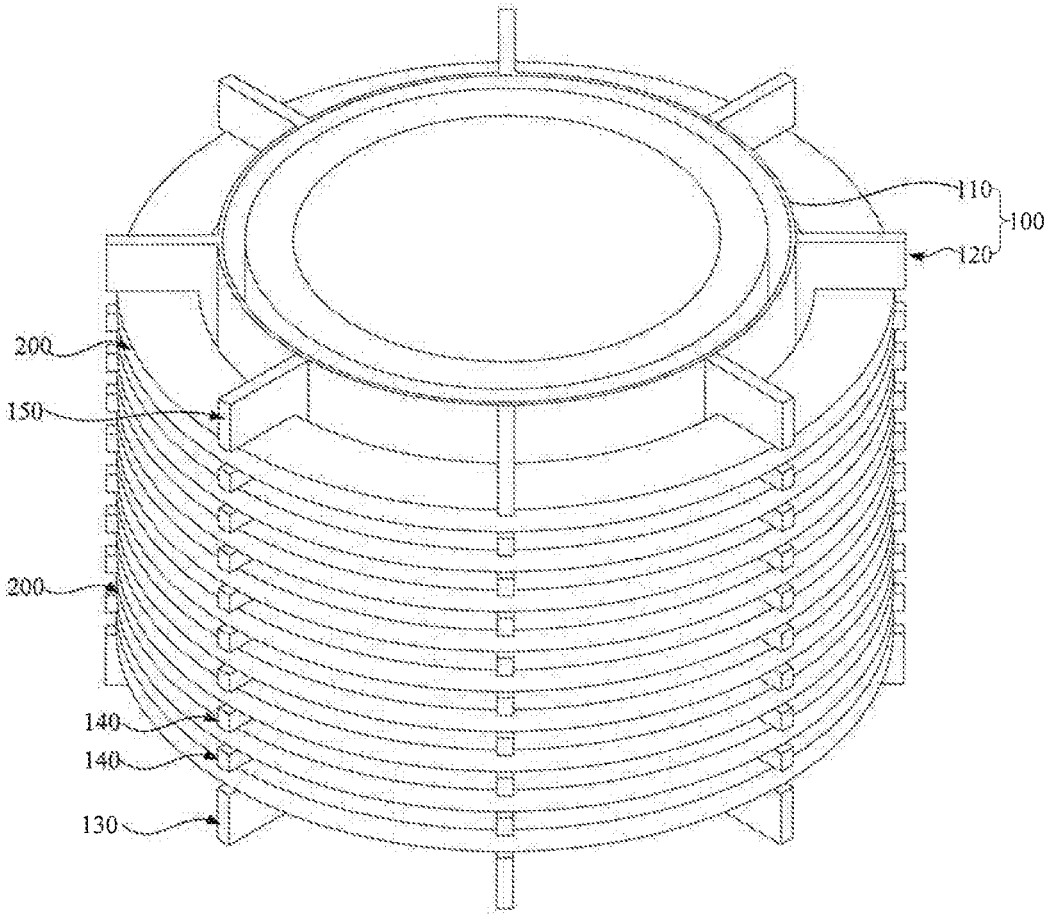
FIG. 1 shows a schematic structural perspective view of the coil structure for a dry-type transformer as described in an embodiment of the present disclosure.
Figure 3:
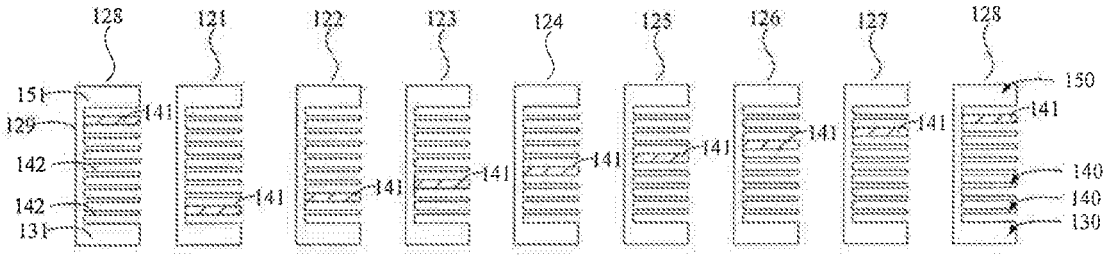
FIG. 3 shows a schematic structural view of each supporting strut as described in an embodiment of the present disclosure.

As shown in FIG. 1, a coil structure for a dry-type transformer includes multiple coil layers 200 formed by winding a wire, and a supporting framework 100 for fixing the coil layers 200. The multiple coil layers 200 are connected in series to form a coiled continuous coil. The supporting framework 100 is provided with multiple supporting layers. One coil layer 200 is disposed between each two adjacent supporting layers. Each of the supporting layers includes several spacer blocks spaced along a circumferential direction, and the spacer blocks of the different supporting layers are vertically arranged with an upper spacer block and a lower spacer block oppositively. The supporting layers include a first supporting layer 130, a last supporting layer 150 and several intermediate supporting layers 140 disposed between the first supporting layer 130 and the last supporting layer 150. The first supporting layer 130 is configured to limit the first coil layer 200, the last supporting layer 15 is configured to limit the last coil layer 200, and the intermediate supporting layers 140 enable the rising between the coil layers 200. As shown in FIG. 3, the spacer blocks of each intermediate supporting layer 140 include a rising spacer block 141 (all of the spacer blocks with hatching as shown in FIG. 3 are rising spacer blocks 141) for rising, supporting spacer blocks 142 (the spacer blocks without hatching on the intermediate supporting layers 140 as shown in FIG. 3 are supporting spacer blocks 142) in addition to the rising spacer blocks 141, and the thicknesses of the rising spacer blocks 141 are greater than the thicknesses of the supporting spacer blocks 142. The rising blocks 141 in several intermediate supporting layers 140 are staggered circumferentially.

Figure 4:
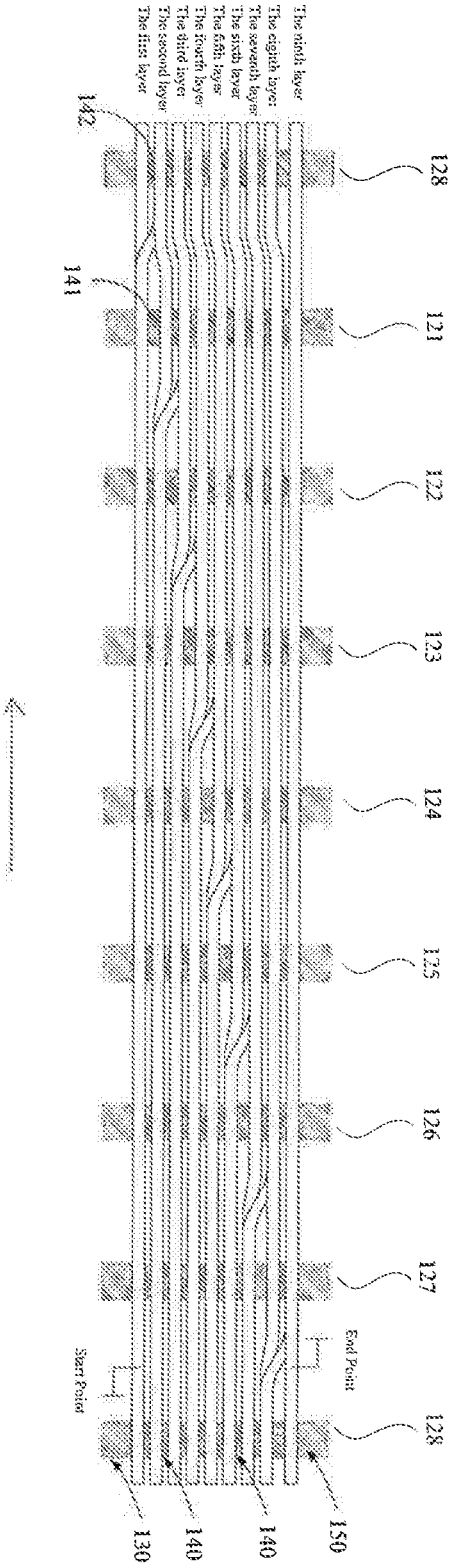
FIG. 4 shows a schematic view of the coil structure, spread out along the circumferential direction, for a dry-type transformer as described in an embodiment of the present disclosure.

The working principle of the coil structure for a dry-type transformer of in the present disclosure will be explained. In order to decrease the height of the entire coil as much as possible, in general the thicknesses of the supporting spacer blocks 142 are less than the thickness of the wire. In contrast, the thicknesses of the rising spacer blocks 141 are required to be greater than or equal to the thickness of the wire, because the requirement for the rising distances are fulfilled by the rising spacer blocks 141 with thicker thicknesses. Referring to FIG. 4, the rising wire can begin from the coiled previous coil layer 200 and through the gap between the rising spacer block 141 and a supporting spacer block 142 adjacent thereto, then the winding of the wire is repeated in sequence of supporting spacer blocks 142—a rising spacer block 141—supporting spacer blocks 142 to form a next coil layer 200. The effect of the rising spacer blocks 141 is to raise the wire at some position, and to provide the rising distance, so as to guarantee the requirements for rising. In meantime the rising spacer blocks 141 of all the intermediate supporting layers 140 are disposed to be staggered circumferentially. That is, not each spacer block on any vertical groups of spacer blocks is needed to be raised or to be thickened as required for rising, instead distributed are the rising distances of the entire coil structure at different circumferential positions, which decreases the height of the entire coil efficiently, saves the usage of wires, decreases the material costs, and in meantime reduces the load losses of transforms, which is not only environmentally friendly but also highly efficient. Furthermore, since the rising positions of the transformer coil layers are distributed at different circumferential positions of the entire coil structure, the concentration degree of the wire in a single area is reduced, which reduces the temperature rise of transformers efficiently, and prolongs the lifetime of transformers. It should be explained that, the winding process of the embodiments shown in FIG. 4 of the present disclosure proceeds from the bottom to the top, where the corresponding first supporting layer 130 is the supporting layer at the bottom, and the last supporting layer 150 is the supporting layer at the top. In other embodiments, the winding process can also proceed from top to bottom, where the corresponding first supporting layer 130 is the supporting layer at the top, the last supporting layer 150 is the supporting layer 150 at the bottom.

Figure 5:
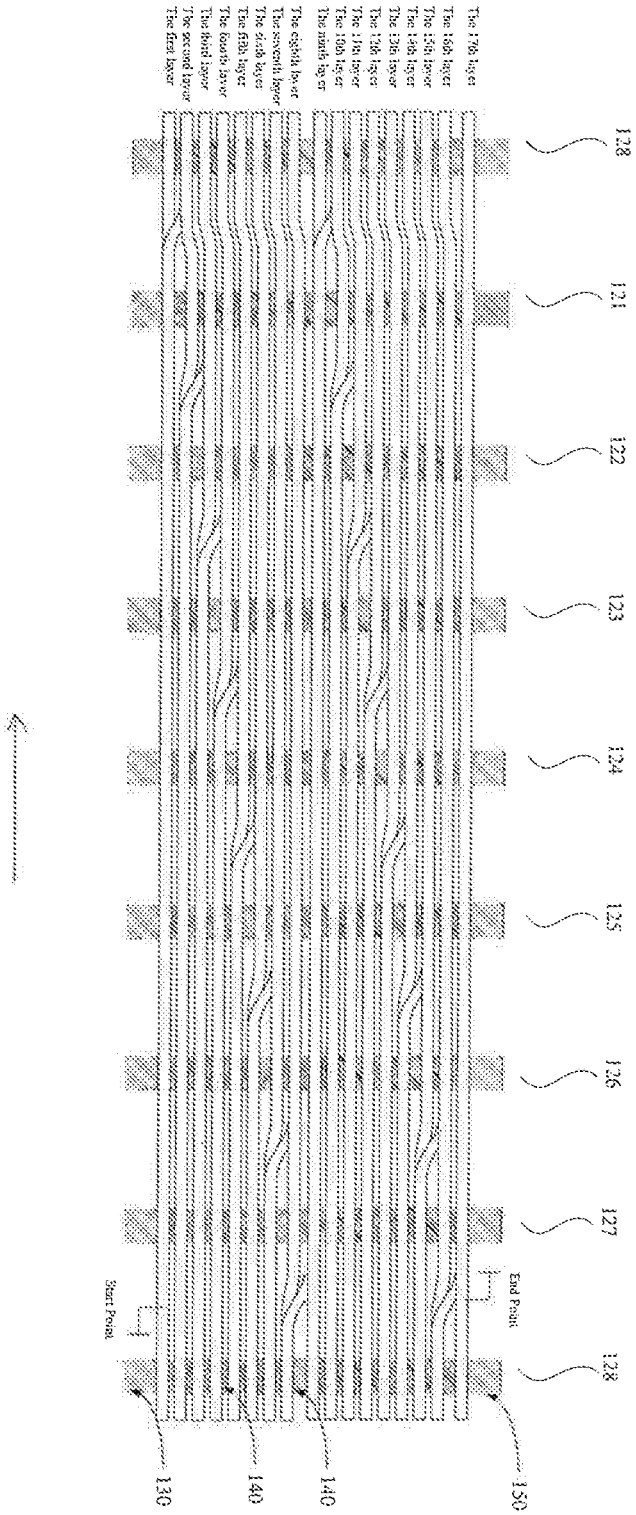
FIG. 5 shows a schematic view of the coil structure, spread out along the circumferential direction, for a dry-type transformer as described in another embodiment of the present disclosure.

In addition, it should also be noted, that the number of the rising spacer blocks on each intermediate supporting layer 140 should not be limited only to one, but also to two or more. For example, when a winding in superposition with two or more sub wires is needed, it is required then to provide a respective number of the rising spacer blocks 141 on each intermediate supporting layer 140 so as to provide the rising positions of each sub wire. The different sub wires rise at different positions along the circumferential direction. Thus, although only one rising spacer block 141 is disposed on the intermediate supporting layers 140 in the embodiments as shown in FIGS. 3-5 of the present disclosure, but indeed the numbers of the rising spacer blocks 141 on each intermediate supporting layer 140 can be determined according to the actual demand.

Optionally, as shown in FIG. 3, the positions, where the rising spacer blocks 141 of several intermediate supporting layers 140 are provided, are disposed to be gradually increasing or decreasing in height along the circumferential direction and are disposed in stepped form so as to enable the winding process of the coil to be regular and convenient, which improves the winding efficiency. It should be noted that, while manufacturing the coil structure of the present disclosure, it is not essential to dispose all of the rising spacer blocks 141 in stepped form to achieve the gradual rising of all the rising spacer blocks 141. All the rising spacer blocks 141 can also be disposed as the following arrangement: e.g. providing a rising spacer block 141 in the second layer of the first vertical group of spacer blocks, providing a rising spacer block 141 in the fourth layer of the second vertical group of spacer blocks, providing a rising spacer block 141 in the sixth layer of the third vertical group of spacer blocks, providing a rising spacer block 141 in the third layer of the fourth vertical group of spacer blocks . . . . It is to be guaranteed there is one rising spacer block 141 to be provided on each intermediate supporting layer 140, and all the rising spacer blocks 141 are disposed to be staggered circumferentially, i.e. the rising blocks 141 will not correspond to each other up-and-down in the vertical direction (in the axial direction).

In the present embodiment, as shown in FIG. 3, surfaces, facing the first supporting layer 130, of each spacer block provided on an intermediate supporting layer 140 closest to the first supporting layer 130, are flush with each other, i.e. the bottom surfaces of all the spacer blocks are flush with each other, so as to guarantee a configuration that the rising spacer block 141 with a thicker thickness can exceed the supporting spacer blocks 142 with a thinner thickness, and thereby provide a larger gap between the layers. The distance between two adjacent supporting layers matches the thickness of a coil layer 200, i.e. the width of a slot between an upper spacer block and a lower spacer block matches the thickness of one coil layer 200, so as to compress the height of the entire coil structure as much as possible.

Further, all of the spacer blocks of the first supporting layer 130 are first limiting spacer blocks 131, all of the spacer blocks of the last supporting layer 150 are second limiting spacer blocks 151, and thicknesses of the first limiting spacer blocks 131 and the second limiting spacer blocks 151 are both greater than thicknesses of the rising spacer blocks 141 so as to meet the intensity requirements for mounting and fixing of the coil.

Here will be explained in detail the structure of the aforementioned supporting framework 100. The supporting framework 100 includes a supporting inner cylinder 110 and a plurality of supporting struts 120 disposed on the outer peripheral surface of the supporting inner cylinder 100 (including 121-128 shown in FIGS. 2-4). A plurality of the supporting struts 120 are disposed to be spaced circumferentially on the outer peripheral surface of the supporting inner cylinder 110. The supporting struts 120 are of comb shape, each of which are provided with several spacer blocks being spaced vertically with an upper spacer block and a lower spacer block oppositively, i.e. each supporting strut 120 is provided with one vertical group of spacer blocks, each of which are in connection with a connecting backplane 129 to each other. There is at least one rising spacer block 141 provided on each supporting strut 120. The present disclosure achieves the circumferential winding by means of the supporting inner cylinder 110, meanwhile the supporting struts provide the vertical groups of spacer blocks to achieve a complete supporting framework with a compact structure. It should be explained that, the present disclosure can provide directly several spacer block matrices, instead of the supporting struts 120, on the supporting inner cylinder 110. Each row of the spacer block matrices provides thickened rising spacer blocks 141.

It should be explained that the structure of the present disclosure is various, one of which provides: the number of the coil layers is defined as m (determined according to the actual situation), $m \geq 3$, thus the number of the supporting layers is $m+1$, the number of the intermediate supporting layers 140 is $m-1$. When all of the supporting struts 120 are provided with one rising spacer block 141, the number of the supporting struts is defined as n, $n=m-1$. When it demands to coil a certain number of the coil layers 200, one rising spacer block 141 can be provided on each supporting strut 120, several rising spacer block 141 are disposed of being staggered circumferentially, and the rising spacer block 141 on each supporting strut 120 provides correspondingly a rising distance of one coil layer. As shown in FIG. 4, the number of the coil layers 200 is nine. The number of the supporting struts 120 is eight. Each supporting strut 120 is provided one rising spacer block 141 thereon. Each supporting strut 120 is enabled to be responsible for the rising of one coil layer 200. The rising spacer blocks 141 on different supporting struts 120 are disposed on different layers. By such analogy, when the number of the coil layers 200 is seventeen, the number of the supporting struts is sixteen, where each supporting strut 120 is provided with one rising spacer block 141.

Another structure provides: the number of coil layers is defined as m (determined according to the actual situation), $m \geq 4$, the number of the supporting struts 120 is defined as n (determined according to the actual situation). When $2 \leq n < m-1$, the number of the rising spacer blocks 141 on the supporting struts 120 is defined as x, $x \geq 2$, wherein, $m=x*n+1$ and there are $n-1$ supporting spacer blocks 142 provided between two adjacent rising spacer block 141. When winding a certain number of the coil layers 200, it can also provide two or more rising spacer blocks 141 on the supporting strut 141 so as to correspondingly provide a rising distance respective to the coil layer 200. Then it is possible to decrease the number of the supporting struts 120 in order to reduce the manufacturing costs. In the winding process, if the wire rises at a position of one supporting strut 120, the wire will rise again on the same supporting strut 120 at a distance of $n-1$ layers, so as to achieve the cycle of the winding process. For example, as shown in FIG. 5, when the number of the coil layers 200 to be coiled is seventeen, and the number of the supporting struts 120 is eight, then each supporting strut 120 are provided with two rising spacer blocks 141. The winding process from the tenth coil layer 200 to the seventeenth coil layer 200 repeats the winding process from the second coil layer 200 to the ninth coil layer 200 after the rising of the ninth coil layer 200.

As can be know from the two structures above, the numbers of the rising spacer blocks 141 on each supporting strut 120 therein are same. Nevertheless it should also be explained that, the numbers of the rising spacer blocks 141 on each supporting strut 120 can also be not uniform, the numbers of the rising spacer blocks 141 on different supporting struts 120 can be different, and each supporting strut 120 according to the actual demand can be provided with respective numbers of the rising spacer blocks 141. For example, when it demands to coil ten coil layers 200, two rising spacer blocks 141 can be provided on the first supporting strut 121, on which the second rising spacer block 141 is configured for the rising of the tenth coil layer. Then on the other supporting struts 120 can be provided one rising spacer block 141. Another example, two rising spacer blocks 141 can be provided on the first supporting strut 121, three rising spacer blocks 141 can be provided on the second supporting strut 122 etc. The numbers of the rising spacer blocks 141 on the supporting struts 120 must be determined according to the actual winding situation. In this case, the number of the coil layers 200, the number of the supporting struts 120 and the number of the rising spacer blocks 141 on the supporting struts 120 do not have a direct relationship among them, and may not satisfy the formulas for the two structures. Therefore, the numbers of the rising spacer blocks 141 on each supporting struts 120 can be uniform or not.

Furthermore, with reference to FIG. 4 or FIG. 5, the present disclosure provides a winding method relating to the aforementioned coil structure for a dry-type transformer, specifically includes the following steps.

Step 1: winding a first coil layer 200 on a first supporting layer 130.

Step 2: rising along a winding direction (all of the arrows in FIGS. 2, 4 and 5 indicating the winding direction) within a gap between a rising spacer block 141 on a next supporting layer and a supporting spacer block 142 adjacent to the rising spacer block, repeating the winding in a sequence of supporting spacer blocks 142—a rising spacer block 141—supporting spacer blocks 142 to form a second coil layer 200. The sectional block areas with a thicker thickness denote the rising spacer blocks 141, and the sectional block areas with thinner thickness denote the supporting spacer blocks 142.

Step 3: according to the regular of step 2 repeating the winding for a third coil layer, and a fourth coil layer . . . , wherein rising positions of the respective coil layers being staggered along a circumferential direction.

Figure 2:
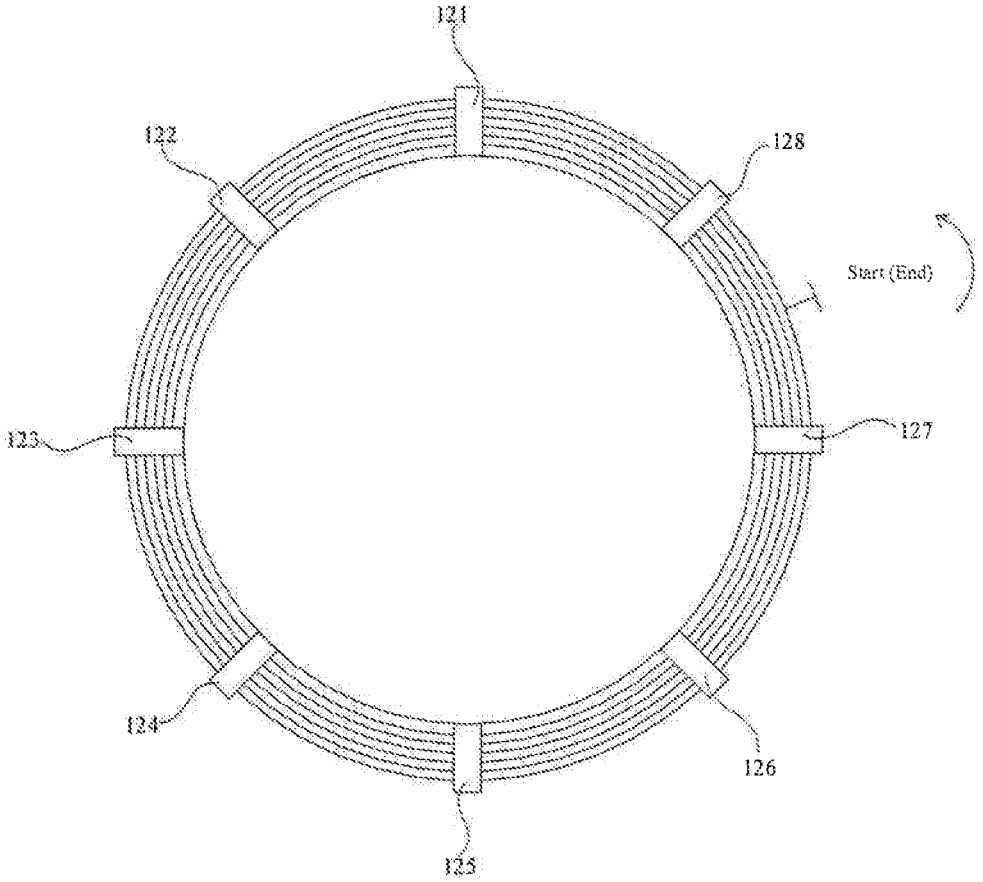
FIG. 2 shows a top view of the coil structure for a dry-type transformer as described in an embodiment of the present disclosure.

Specifically, as shown in FIG. 2, the transformer coil has eight comb-shaped supporting struts 120 as the supporting framework 100 for the coil. Along the counterclockwise direction as shown in drawings are named as the first supporting strut 121, the second supporting strut 122, the third supporting strut 123 . . . and so on; the transformer coil consists of nine coil layers 200. As counting from the bottom to the top they are respectively named the first layer, the second layer, the third layer . . . and so on;

As shown in FIG. 4, the wire begins the winding from the first supporting layer 130 and at a position between the seventh supporting strut 127 and the eighth supporting strut 128 as the start point, along the counterclockwise direction according to the circumferential schematic view of the coil.

When the number of coiled turns of the first coil layer reaches the number required in the design, the wire proceeds with the rising between the first supporting strut 121 and the eighth supporting strut 128 from the first coil layer 200 to the second coil layer 200, where the first supporting strut 121 provides one rising spacer block 141 with a thicker thickness (i.e. a larger thickness between the layers) at the position as shown in drawings for the rising requirements.

After the rising from the first coil layer 200 to the second coil layer 200, the transformer coil continues the winding along the original winding direction until the number of the coiled turns reaches the number required in the design. Then the transformer coil rises between the second supporting strut 122 and the first supporting strut 121 from the second coil layer 200 to the third coil layer 200. The second supporting strut 122 provides one rising spacer block 141 with a thicker thickness (i.e. a larger distance between the layers) at the position as shown in drawings.

After the rising from the second coil layer 200 to the third coil layer 200, the transformer coil continues the winding along the original winding direction until the number of the coiled turns reaches the number required in the design. Then the transformer coil rises between the third supporting strut 123 and the second supporting strut 122 from the third coil layer 200 to the fourth coil layer 200. The third supporting strut 123 provides one rising spacer block 141 with a thicker thickness (i.e. a larger distance between the layers) at the position as shown in drawings.

By such analogy, the winding of the rest coil layers 200 will be completed.

It should be explained that, when it demands to coil seventeen coil layers 200, the first nine coil layers 200 should be successively completed according to the above mentioned steps, then proceed with rising between the first supporting strut 121 and the eighth supporting strut 128 from the ninth coil layer 200 to the tenth coil layer 200. The first supporting strut 120 provides another rising spacer block 141 with a thicker thickness (i.e. a larger distance between the layers) at the position as shown in drawings. By such analogy, complete the winding from the tenth layer to the seventeenth layer. The winding processes of 9 coil layers 200 and 17 coil layers 200 are provided only for illustrating the present disclosure. When it demands to coil coil layers 200 with other numbers, the winding can be completed referring to the winding method of the coil structure for a dry-type transformer above.

The winding method for the coil structure for a dry-type transformer as described in the embodiments of the present disclosure, by means of distributing all of the rising positions of the coil structure at different circumferential positions, decreases the height of the entire coil efficiently, saves the usage of wires, decreases the material costs, and in meantime reduces the load losses of transforms, which is not only environmentally friendly but also highly efficient. Furthermore, since the rising positions of the transformer pancake coil are distributed at different circumferential positions of the entire coil structure, the concentration degree of the wire in a single area is reduced, which reduces the temperature rise of transformers efficiently, and prolongs the lifetime of transformers. Additionally because the rising positions of the transformer pancake coil are distributed at different circumferential positions of the entire coil structure, the anti-short circuit ability of transformer coils are enhanced.

In one of the embodiments, the rising positions of the respective coil layers are disposed to be gradually increasing or decreasing in height along the circumferential direction so as to enable the entire winding process of the coil structure to be more regular, which simplifies the winding process and improves the winding efficiency.

All of the technical characteristics above described in the embodiments can be employed in arbitrary combinations. In an effort to provide a concise description of these embodiments, not all arbitrary combinations of the technical characteristics in the aforementioned embodiments are described in the specification. However, if such combinations of the technical characteristics are not clearly contradictory, they should be considered as described within the scope of the specification.

The above mentioned embodiments, which interpret only a few implementation, are described specific and in detail, but which are not to be construed as limitations to the sought protection scope of the disclosure. It should be pointed out that, further modifications and improvements within the scope of the tenets of the disclosure shall be within the protection scope of the disclosure to the skilled persons in the art.

The invention claimed is:

1. A coil structure for a dry-type transformer, comprising a multiple-layer pancake coil formed by winding a wire, and a supporting framework for fixing the pancake coil; the supporting framework is provided with multiple supporting layers, one coil layer is disposed between each two adjacent supporting layers, each of the supporting layers comprises several spacer blocks spaced along a circumferential direction, and the supporting layers comprise a first supporting layer, a last supporting layer and several intermediate supporting layers disposed between the first supporting layer and the last supporting layer; the spacer blocks of each intermediate supporting layer comprise a rising spacer block for rising and supporting spacer blocks in addition to the rising spacer block, a thickness of the rising spacer block being greater than a thickness of the supporting spacer block, and the rising spacer blocks of several intermediate supporting layers being staggered along the circumferential direction and being disposed in a stepped form along the circumferential direction.

2. The coil structure for a dry-type transformer of claim 1, wherein surfaces, facing the first supporting layer, of each spacer block provided on an intermediate supporting layer closest to the first supporting layer, are flush with each other, and a distance between two adjacent supporting layers matches a thickness of a coil layer.

3. The coil structure for a dry-type transformer of claim 1, wherein all of the spacer blocks of the first supporting layer are first limiting spacer blocks, all of the spacer blocks of the last supporting layer are second limiting spacer blocks, and thicknesses of the first limiting spacer blocks and the second limiting spacer blocks are greater than thicknesses of the rising spacer blocks.

4. The coil structure for a dry-type transformer of claim 1, wherein the spacer blocks of the different supporting layers are vertically arranged with an upper spacer block and a lower spacer block oppositively to form a plurality of vertical groups of spacer blocks, each group of vertical spacer blocks forming a supporting strut via a connecting backplane; the supporting framework further comprises a supporting inner cylinder, a plurality of the supporting struts spaced circumferentially along an outer peripheral surface of the supporting inner cylinder, and each supporting strut provided with at least one rising spacer block.

5. The coil structure for a dry-type transformer of claim 4, wherein a number of the coil layers is defined as m, m≥3, a number of the supporting struts is defined as n, $n=m-1$, and each supporting strut is provided thereon with one rising spacer block.

6. The coil structure for a dry-type transformer of claim 4, wherein a number of the coil layers is defined as m, $m \geq 4$, a number of the supporting struts is defined as n, $2 \leq n < m-1$, and a number of the rising spacer blocks on the supporting struts is defined as x, $x \geq 2$, wherein $m=x*n+1$ of the supporting struts; $n-1$ supporting spacer blocks are provided between two adjacent rising spacer blocks.

7. The coil structure for a dry-type transformer of claim 4, wherein the number of the rising spacer blocks on each supporting strut are not uniform.

* * * * *